US005996175A

United States Patent [19]

Fusco

[11] Patent Number: 5,996,175

[45] Date of Patent: Dec. 7, 1999

[54] ADJUSTABLE VACUUM HANDLE CONSTRUCTION

[76] Inventor: Edward Fusco, 220 Clearfield Ave., Norristown, Pa. 19403

[21] Appl. No.: 09/121,640

[22] Filed: Jul. 23, 1998

[51] Int. Cl.[6] ..... A47L 9/32

[52] U.S. Cl. ..... 15/410; 15/144.1; 16/144 R

[58] Field of Search ..... 15/410, 144.1; 16/114 R

[56] References Cited

U.S. PATENT DOCUMENTS

| | | | |
|---|---|---|---|
| 1,014,776 | 1/1912 | Rubel | 15/410 |
| 1,094,050 | 4/1914 | Beach | 15/144.1 X |
| 1,939,579 | 12/1933 | Swartz | 15/410 X |
| 2,775,779 | 1/1957 | Nelson | 15/144.1 X |
| 3,357,035 | 12/1967 | Ficke | 15/144.1 |
| 4,662,026 | 5/1987 | Sumerau et al. . | |
| 4,715,084 | 12/1987 | Jacob et al. | 15/410 X |
| 4,980,945 | 1/1991 | Bewley | 15/410 X |
| 5,016,315 | 5/1991 | Bledsoe et al. . | |
| 5,109,568 | 5/1992 | Rohn et al. . | |
| 5,207,755 | 5/1993 | Ampian | 15/144.1 X |
| 5,564,160 | 10/1996 | Luebbering . | |

FOREIGN PATENT DOCUMENTS

| | | | |
|---|---|---|---|
| 62992 | 3/1994 | Japan | 15/410 |

*Primary Examiner*—Chris K. Moore
*Attorney, Agent, or Firm*—Henderson & Sturm

[57] ABSTRACT

An adjustable vacuum handle construction 10 including a collar member 20 dimensioned to fit over and be secured to the rearwardly angled generally straight tubular hand grip portion 102 of a conventional vacuum handle 101. A handle member 30 is pivotally secured to the collar member 20 and provided with a locking unit 13 for fixedly securing the handle member 30 to the collar member 20 at a desired angular orientation.

9 Claims, 2 Drawing Sheets

ADJUSTABLE VACUUM HANDLE CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of vacuum cleaners in general, and in particular to an adjustable handle construction for a vacuum cleaner.

2. Description of Related Art

As can be seen by reference to the following U.S. Pat. Nos. 4,662,026; 5,016,315; 5,109,568; and 5,564,160, the prior art is replete with myriad and diverse handle constructions for vacuum cleaners.

While all of the aforementioned prior art constructions are more than adequate for the basic purpose and function for which they have been specifically designed, they are uniformly deficient with respect to their failure to provide a simple, efficient, and practical handle construction for vacuum cleaners that can be angularly adjustable, not only to suit the personal preferences of the individual user, but also to reduce the occurrence of carpel tunnel syndrome among individuals who use a vacuum cleaner on a daily basis.

As most individuals in the building maintenance field are all too well aware, even the most ergonomically designed rigid vacuum handle construction can lead to a repetitive motion injury with continued usage.

As a consequence of the foregoing situation, there has existed a longstanding need for a new and improved type of adjustable vacuum handle construction that cannot only be adjusted to a preferred position, but whose position can be varied to reduce the occurrence of repetitive motion injuries, and the provision of such a construction is a stated objective of the present invention.

BRIEF SUMMARY OF THE INVENTION

Briefly stated, the adjustable vacuum handle construction that forms the basis of the present invention comprises in general, a collar unit, a handle unit pivotally connected to the collar unit and a locking unit for securing the handle unit at a desired angular orientation relative to the collar unit.

As will be explained in greater detail further on in the specification, the collar unit includes a collar member that has a first end adapted to receive and be secured to the rearwardly angled generally straight tubular hand grip portion of a conventional vacuum cleaner handle.

In addition, the second end of the collar member is adapted to be pivotally secured to the handle unit which includes a handle member whose lower end is received in the second end of the collar member. The locking unit will selectively engage the handle member to the collar member at a desired angular orientation.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 2:
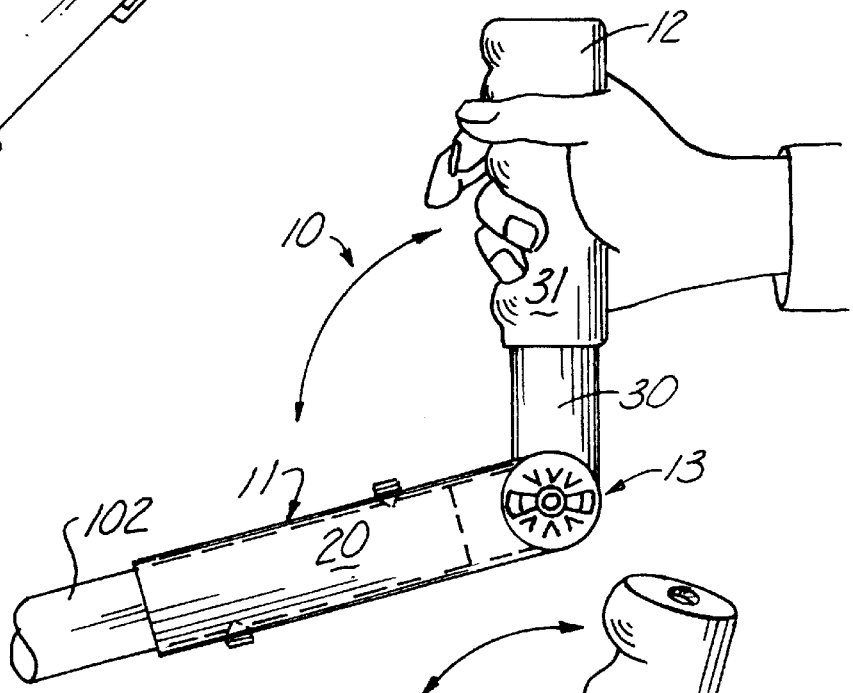
FIG. 2 is a perspective view of the adjustable vacuum handle construction mounted on a conventional straight vacuum handle.

As can be seen by reference to the drawings, and in particularly to FIG. 2, the adjustable vacuum handle construction that forms the basis of the present invention is designated generally by the reference number 10. The construction 10 comprises in general, a collar unit 11, a handle unit 12, and a locking unit 13. These units will now be described in seriatim fashion.

Figure 1:
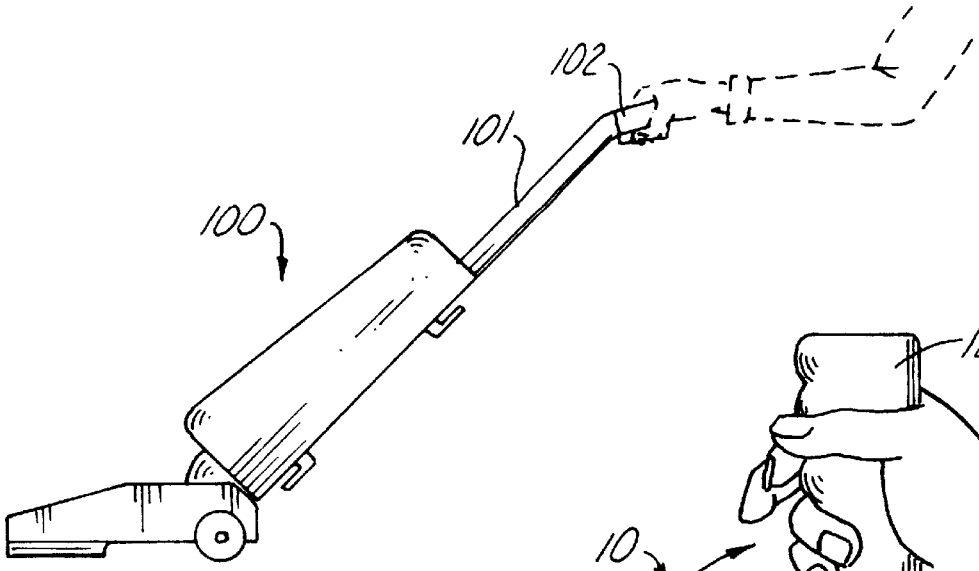
Fig. 1 PRIOR ART
FIG. 1 is a depiction of a conventional vacuum cleaner having a prior art straight handle construction.

Prior to embarking on a detailed description of the adjustable vacuum handle construction 10, it would first be advisable to describe the prior art vacuum handle depicted in FIG. 1 that the construction 10 is intended for use in conjunction with.

As shown in FIG. 1 a conventional vacuum cleaner 100 is normally provided with an upwardly extending handle member 101 provided with a rearwardly angled generally straight tubular hand grip portion 102.

Turning now to FIG. 2, it can be seen that the collar unit 11 comprises a generally hollow cylindrical collar member 20 that is dimensioned to slidably receive the hand grip portion 102 of the prior art vacuum handle 101.

Figure 3:
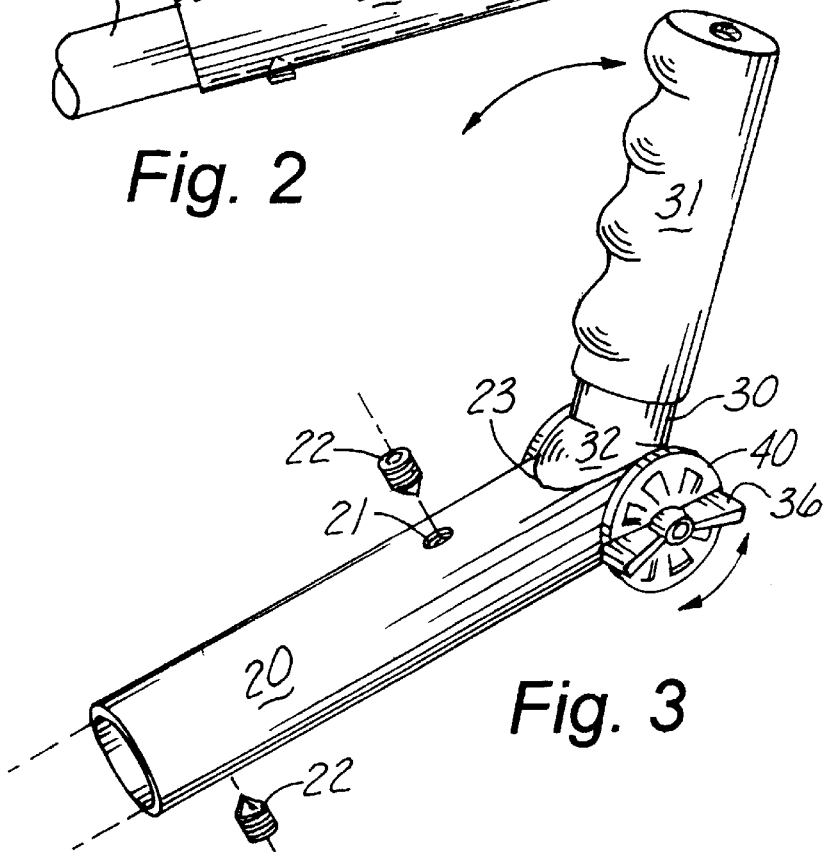
FIG. 3 is an isolated perspective view of the adjustable vacuum handle construction.

In addition, as shown in FIGS. 2 and 3, the tubular collar member 20 is provided with a plurality of off set apertures 21 which are dimensioned to receive conventional fasteners 22 for fixedly securing the collar member 20 to the hand grip portion 102 of the conventional vacuum cleaner 100.

Figure 4:
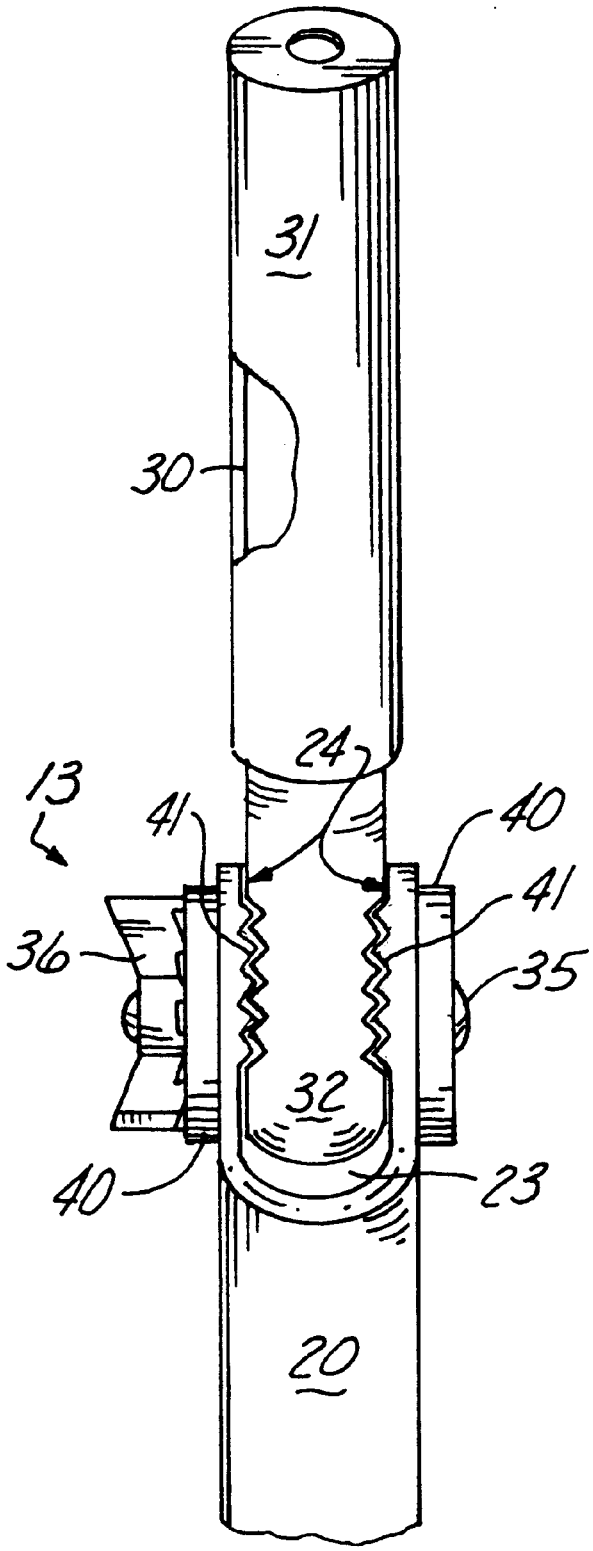
FIG. 4 is a cut away view of the connection between the handle unit, the collar unit, and the locking unit.

Furthermore, as shown in FIGS. 3 and 4, the outboard end of the collar member 20 is provided with enlarged arcuate recesses 23 that are opposed to one another and aligned in a vertical plane and a pair of enlarged laterally opposed apertures 24 wherein the purpose and function of the recesses 23 and apertures 24 will be explained in greater detail further on in the specification.

As shown in FIGS. 2 through 4, the handle unit 12 comprises in general a generally tubular handle member 30 having a contoured hand grip element 31 provided on its upper end and a toothed disk element 32 formed on its lower end. The purpose and function of the toothed disk element 32 will be explained presently in conjunction with the locking unit 13.

As can best be seen by reference to FIG. 4, the locking unit 13 comprises a pair of hub elements 40 having inwardly facing toothed surfaces 41 which are dimensioned to be received in the lateral apertures 24 of the collar member 20 and to engage the toothed surfaces of the disk element 32.

Furthermore, both the hub elements 40 and the disk element 32 are provided with a central aperture (not shown)

dimensioned to receive a pivot rod 35 provided with at least one conventional fastener 36 for pivotally connecting the handle member 30 to the collar member 20 in a well recognized fashion. The angle of the handle member 30 relative to the collar member 20 can be adjusted by loosening the fastener 36 to disengage the hubs 40 from the disk element 32 rotating the disk element 32 to the desired angular orientation and retightening the fastener 36.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An adjustable vacuum handle construction for a conventional vacuum handle having a rearwardly angled generally straight tubular hand grip portion wherein the adjustable vacuum handle construction comprises:

a collar unit including a generally cylindrical collar member dimensioned to receive and adapted to be operatively connected to the hand grip portion of the conventional vacuum handle;

a handle unit including a generally tubular handle member pivotally connected to said collar member; and a locking unit for fixedly securing the handle member at a desired angular orientation relative to said collar member.

2. The construction as in claim 1 wherein the lower end of the handle member is pivotally secured to one end the collar member and the other end of the collar member is dimensioned to receive the hand grip portion of the conventional vacuum handle.

3. The construction as in claim 2 wherein the upper end of the handle member is provided with a contoured hand grip element.

4. The construction as in claim 3 wherein the lower end of the handle member and the said one end of the collar member are provided with aligned apertures dimensioned to receive a pivot rod.

5. The construction as in claim 4 wherein said pivot rod is provided with at least one fastener for fixedly securing the handle member to the collar member.

6. The construction as in claim 4 wherein the lower end of the handle member is provided with a toothed disk and the said one end of the collar member is provided with a pair of vertically aligned recesses dimensioned to receive said toothed disk.

7. The construction as in claim 6 wherein said one end of the collar member is provided with a pair of laterally aligned apertures adapted to be aligned relative to a portion of said toothed disk.

8. The construction as in claim 7 wherein said locking unit comprises at least one hub element having an inwardly facing toothed surface dimensioned to be received in at least one of the laterally aligned apertures in the collar member and dimensioned to frictionally engage a complementary portion of said toothed disk.

9. The construction as in claim 8 wherein said locking unit further includes:

means for selectively frictionally engaging the inwardly facing toothed surface of said at least one hub element with the complementary portion of said toothed disk.

* * * * *